US011404226B2

(12) United States Patent
Duncan et al.

(10) Patent No.: US 11,404,226 B2
(45) **Date of Patent: *Aug. 2, 2022**

(54) BUTTON WITH ILLUMINATION RING

(71) Applicant: GOOGLE LLC, Mountain View, CA (US)

(72) Inventors: Scott Duncan, Sunnyvale, CA (US); Chee Sen Poh, San Jose, CA (US); Jacqueline Laiz, San Jose, CA (US); Anurag Gupta, Mountain View, CA (US); Shelomon Doblack, Santa Clara, CA (US); Alexander Wroblewski, Santa Clara, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/392,947

(22) Filed: Aug. 3, 2021

(65) Prior Publication Data

US 2021/0366670 A1 Nov. 25, 2021

Related U.S. Application Data

(63) Continuation of application No. 16/867,147, filed on May 5, 2020, now Pat. No. 11,107,648, which is a continuation of application No. PCT/US2019/034207, filed on May 28, 2019.

(51) Int. Cl.

| | |
|---|---|
| ***H01H 13/02*** | (2006.01) |
| ***F21V 3/06*** | (2018.01) |
| ***F21V 19/00*** | (2006.01) |
| *F21Y 115/10* | (2016.01) |

(52) U.S. Cl.
CPC ..... *H01H 13/023* (2013.01); *F21V 3/0625* (2018.02); *F21V 19/001* (2013.01); *F21Y 2115/10* (2016.08); *H01H 2219/0622* (2013.01)

(58) Field of Classification Search
CPC ..... H01H 19/025; H01H 13/023; H01H 2219/0622
USPC ..... 362/23.05
See application file for complete search history.

(56) References Cited

U.S. PATENT DOCUMENTS

| | | | | | |
|---|---|---|---|---|---|
| 4,590,342 | A * | 5/1986 | Schlegel | H01H 13/023 | 200/341 |
| 4,885,443 | A * | 12/1989 | Simcoe | H01H 13/023 | 200/344 |
| 5,285,037 | A * | 2/1994 | Baranski | H01H 13/023 | 200/314 |
| 5,510,782 | A * | 4/1996 | Norris | H01H 13/705 | 200/314 |
| 5,711,588 | A * | 1/1998 | Rudisill | F21S 43/14 | 362/23.05 |

(Continued)

*Primary Examiner* — William N Harris

(57) ABSTRACT

A hardware product for creating a light ring and a dead front effect. The product may include a housing with an opening. The hardware product may also include a button positioned within the opening and configured to be depressed by a user. The button is constructed using a two-part molding process and includes a first shot and a second shot. The first shot is configured to disperse light around the perimeter shape of the opening. The second shot is constructed from an optically opaque or semi-opaque material. A single light-emitting component electrically coupled to the circuit board provides light for creating the light ring.

19 Claims, 7 Drawing Sheets

(56) References Cited

U.S. PATENT DOCUMENTS

| | | | | |
|---|---|---|---|---|
| 5,993,019 | A * | 11/1999 | Kline | G09F 13/04 362/23.05 |
| 8,093,521 | B2 * | 1/2012 | Wang | H01H 13/023 200/566 |
| 8,360,595 | B2 * | 1/2013 | Chang | H01H 13/83 362/23.05 |
| 8,783,884 | B2 * | 7/2014 | Baker | H01H 9/181 362/23.05 |
| 8,878,087 | B2 * | 11/2014 | Lee | H01H 13/84 362/23.05 |
| 9,778,406 | B2 * | 10/2017 | Yang | G06F 3/03547 |
| 10,590,600 | B1 * | 3/2020 | Wang | H01H 13/023 |
| 11,276,268 | B2 * | 3/2022 | Lewis | G06F 3/0202 |
| 2005/0168966 | A1 * | 8/2005 | Maeda | H01H 25/041 362/23.05 |
| 2017/0309418 | A1 * | 10/2017 | Schaefer | G05G 1/02 |

* cited by examiner

500

520

BUTTON WITH ILLUMINATION RING

CROSS-REFERENCE TO RELATED APPLICATIONS

The present application is a continuation application of U.S. patent application Ser. No. 16/867,147, entitled "BUTTON WITH ILLUMINATION RING" and filed on 5 May 2020, and International Patent Application Serial No. PCT/US2019/034207, entitled "BUTTON WITH ILLUMINATION RING" and filed on 28 May 2019, the entirety of which are incorporated by reference herein.

BACKGROUND

Hardware products frequently employ illumination to achieve user interface, industrial design, and marketing goals. Illumination can convey a message or status indication to a user using color or by varying in intensity. Products may also be differentiated from one another based on an illumination scheme.

A button on a hardware product may employ illumination in the form of a "ring" of light that surrounds the perimeter of the button. Alight ring may be implemented using multiple light-emitting diodes (LEDs) positioned to approximate the shape of a ring. Light rings may also use dedicated optical components, such as light diffusers, light pipes, and/or light guides to direct and channel the light into the desired light pattern. Because the optical components used to achieve the light ring effect occupy the limited space surrounding the button, additional complexity and costs are imposed to ensure that those components do not interfere with the function of the button.

"Dead front" is a design aesthetic where a device's illuminating elements are at least partially obscured when in the off state. Providing a dead front effect for a light ring typically involves additional processing and/or light-reflecting parts, and coatings; all of which add to the cost of the final product.

BRIEF SUMMARY

According to an embodiment of the disclosed subject matter, a hardware product may include a housing having an opening defined by a perimeter shape. The housing may consist essentially of an optically opaque or semi-opaque material. The hardware product may also include a button configured to be depressed along a depression axis and positioned within the opening. The button may be spaced from the perimeter of and centered within the opening within the housing by a first gap and a second gap immediately adjacent to the first gap. The first gap may taper to a minimum dimension where it meets the second gap. The second gap may taper to a minimum dimension where it meets the first gap. The maximum dimension of the second gap may be less than the maximum dimension of the first gap. The maximum dimension of the first gap may be in a range of 0.15-0.25 mm, 0.20-0.24 mm, approximately 0.22 millimeters, or the like. The maximum dimension of the second gap may be 0.10-0.20 mm, 0.14-0.16 mm, approximately 0.15 millimeters, or the like. The second gap may be disposed adjacent to the first gap in parallel with the depression axis of the button.

The hardware product may include an internal cavity positioned adjacent to the second gap. The printed circuit board, silicone web, and light-emitting component may all be positioned within the internal cavity.

The button may include a first shot of material constructed from a first light-diffusion grade polycarbonate material configured to uniformly disperse light and spaced from the perimeter of the opening by the first gap and the second gap. The first shot of material may be positioned or sized such that it protrudes outward from the housing. The button may also include a second shot constructed from a second polycarbonate or acrylonitrile butadiene styrene material. The second shot material may be optically opaque or semi-opaque. The button may have a radially symmetric molding gating.

The hardware product may also include only a single light-emitting component electrically coupled to a printed circuit board. The hardware product may also include multiple light-emitting components positioned within a diameter of a circle that is less than or equal to 75-85%, 80%, or the like of a diameter of an exterior-facing surface of the button.

The hardware product may also include a resilient silicone web configured to cause closure of a circuit upon depression of the button and to return the button to its original position after being depressed. The resilient silicone web may have an opening centrally aligned with the light-emitting component and may be configured to allow light from the light-emitting component to pass to the second shot.

The hardware product may also include a shroud constructed from an optically opaque or semi-opaque material and may be configured to surround at least a portion of the button.

The hardware product may also include a first shot molding gate disposed underneath and obscured from view by the second shot. The hardware product may also include a second shot molding gate disposed on and centered on the underside of the button.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Creating a light ring effect on a hardware product may be complicated and costly to implement. The light ring effect may be accomplished by providing several dedicated optical components, such as light tubes, guides, and diffusers within a limited space. Concealing these dedicated optical components when the light ring is off to achieve a dead front effect may incur additional expense in terms of processing, parts, and coatings. Compounding the problem, when designing a light ring to surround a button or joystick, care must be taken to avoid negatively impacting the movement of these components.

The present subject matter discloses structures and techniques to achieve a light ring effect and a dead front effect. When used with a button in one example, the button itself may be used as a light diffuser in conjunction with one or more gaps surrounding the button to achieve the light ring effect without multiple LEDs, dedicated optical parts, or additional processes. The disclosed subject matter may be used in conjunction with a variety of handheld, wall-mounted, and free-standing electronic devices, such as a game controller, game console, remote control, set-top box, thermostat control panel, security system control panel, dimmer/switch, audio system control panel, and the like. The disclosed subject matter may provide visual appeal and utility from a variety of angles and distances, and particularly in dark and semi-dark environments where the light ring effect may be more readily observed.

While the subsequent discussion and associated figures will describe the example embodiments in the context of a dead front light ring effect that surrounds a round button, it should be appreciated that the concepts may apply to non-moving, moveable, and moving components of any shape, such as buttons, directional pads, joysticks, trackballs, wheels, switches, sliders, labels, panels, trackpads, and embossments, for example.

The term "optically opaque" as used herein refers to any material that will block all or essentially all visible light, such that the light transmitted, if any, is not noticeable by the human eye. The optical opacity of a plastic material may be function of material thickness and the amount of colorant used in manufacturing the plastic material.

The term "optically semi-opaque" as used herein refers to a material that will block at least 50% of all visible light. Any plastic material that may be made opaque may also be made semi-opaque by reducing the thickness of the material or by reducing the amount of colorant used in manufacturing the plastic material.

Figure 1:
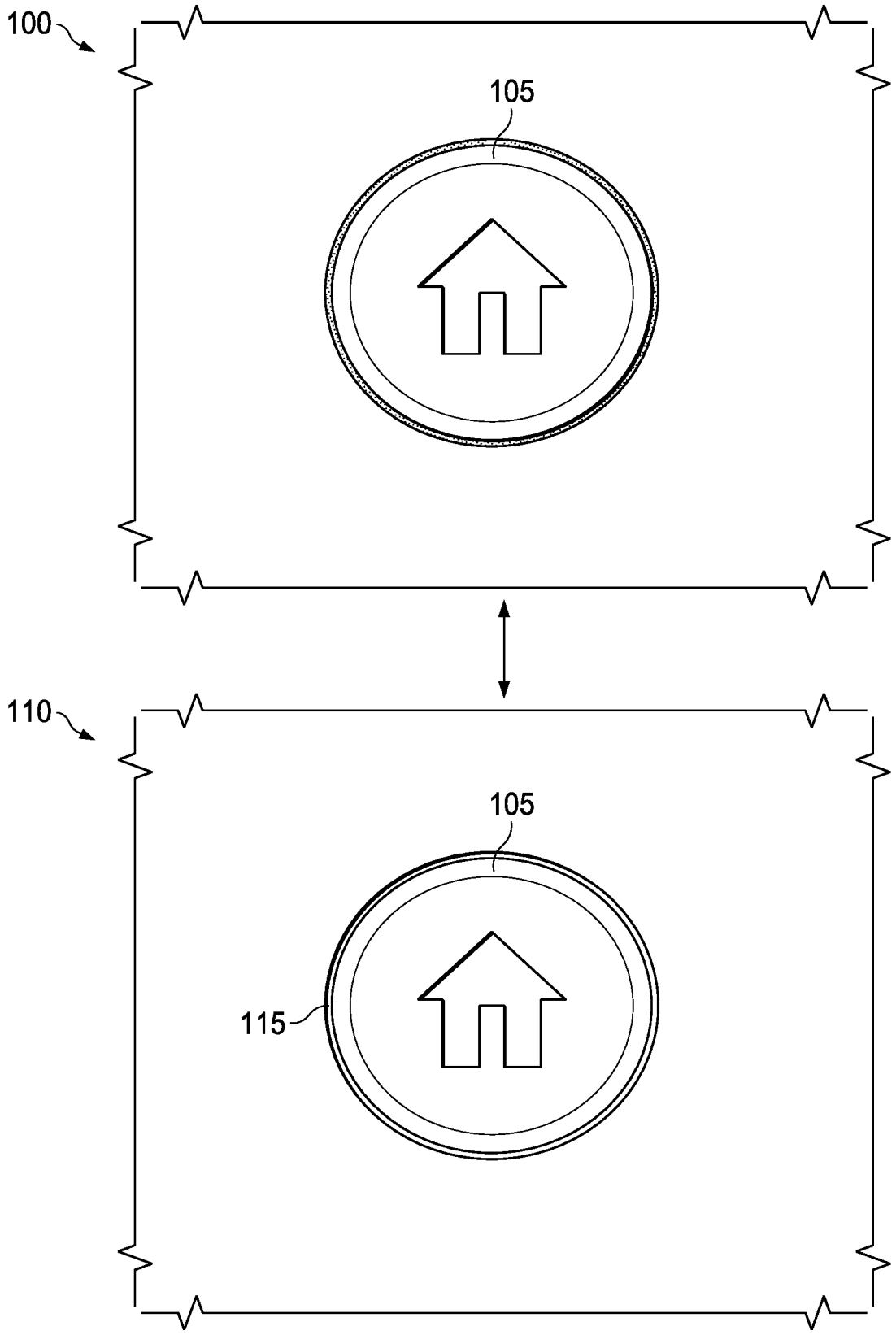
FIG. 1 shows a hardware product according to an embodiment of the disclosed subject matter.

FIG. 1 shows an example of a dead front light ring effect surrounding a button 105 in both the "on" state 100 and "off" state 110. In the on state 100, a ring of light effect may surround button 105, while in off state 110, the ring of light may be eliminated and only a gap 115 surrounding button 105 may be visible. It should be appreciated from FIG. 1 that no LEDs, lenses, or other optical components are visible when in the "off" state 110, thereby achieving the desired dead front effect.

Figure 2:
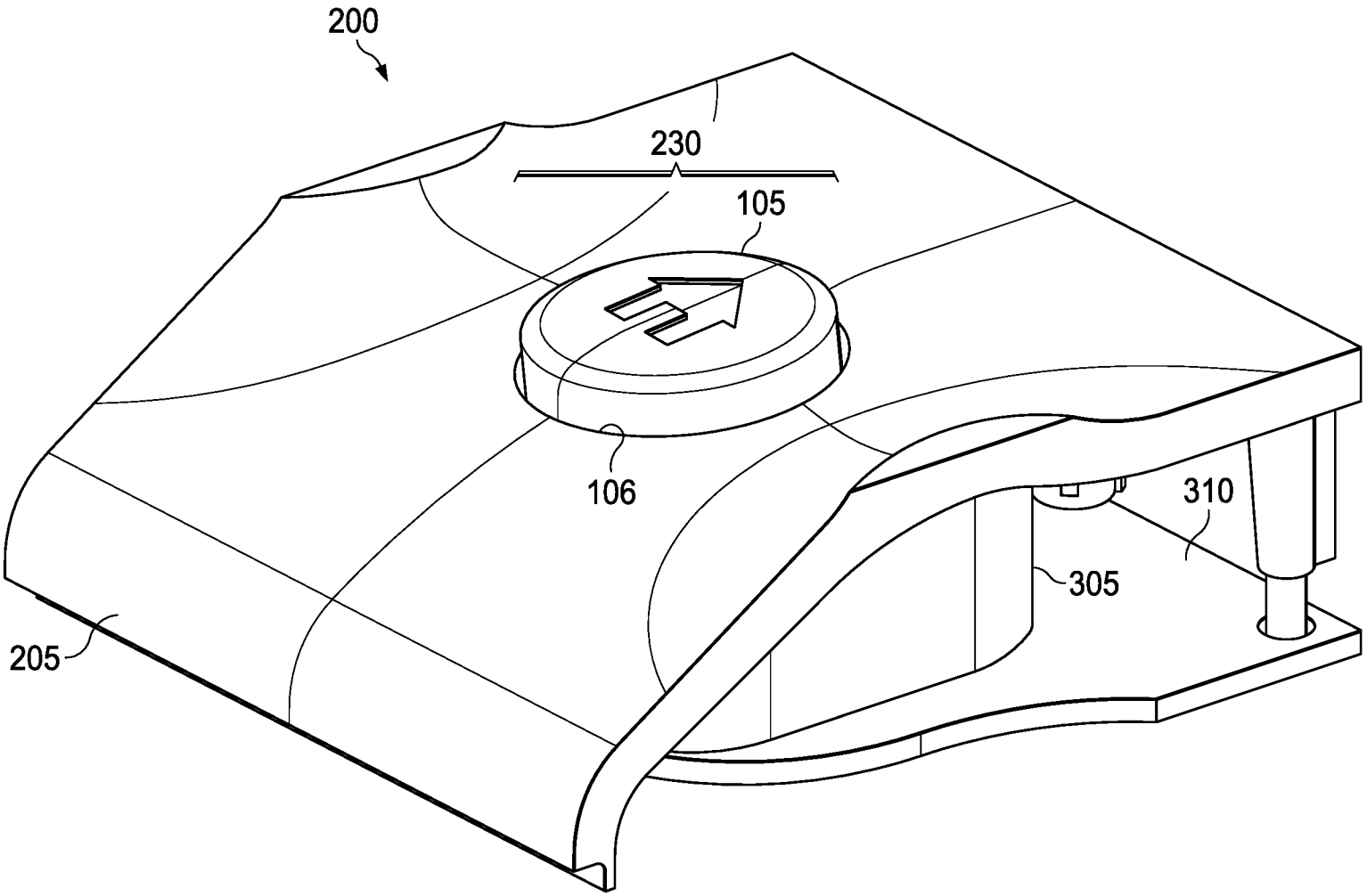
FIG. 2 shows an example cutaway cross-section of a hardware product according to an embodiment of the disclosed subject matter.

FIG. 2 illustrates an example cutaway perspective view of hardware product 200 showing button 105 located within the opening 230 of housing 205, a first injection molding shot 106, optically opaque shroud 305, and printed circuit board (PCB) 310, which is electrically coupled to the single light-emitting component 210 to provide power. Opening 230 preferably may be defined by a perimeter shape that substantially follows the footprint of button 105 as shown in FIG. 2.

Figure 3A:
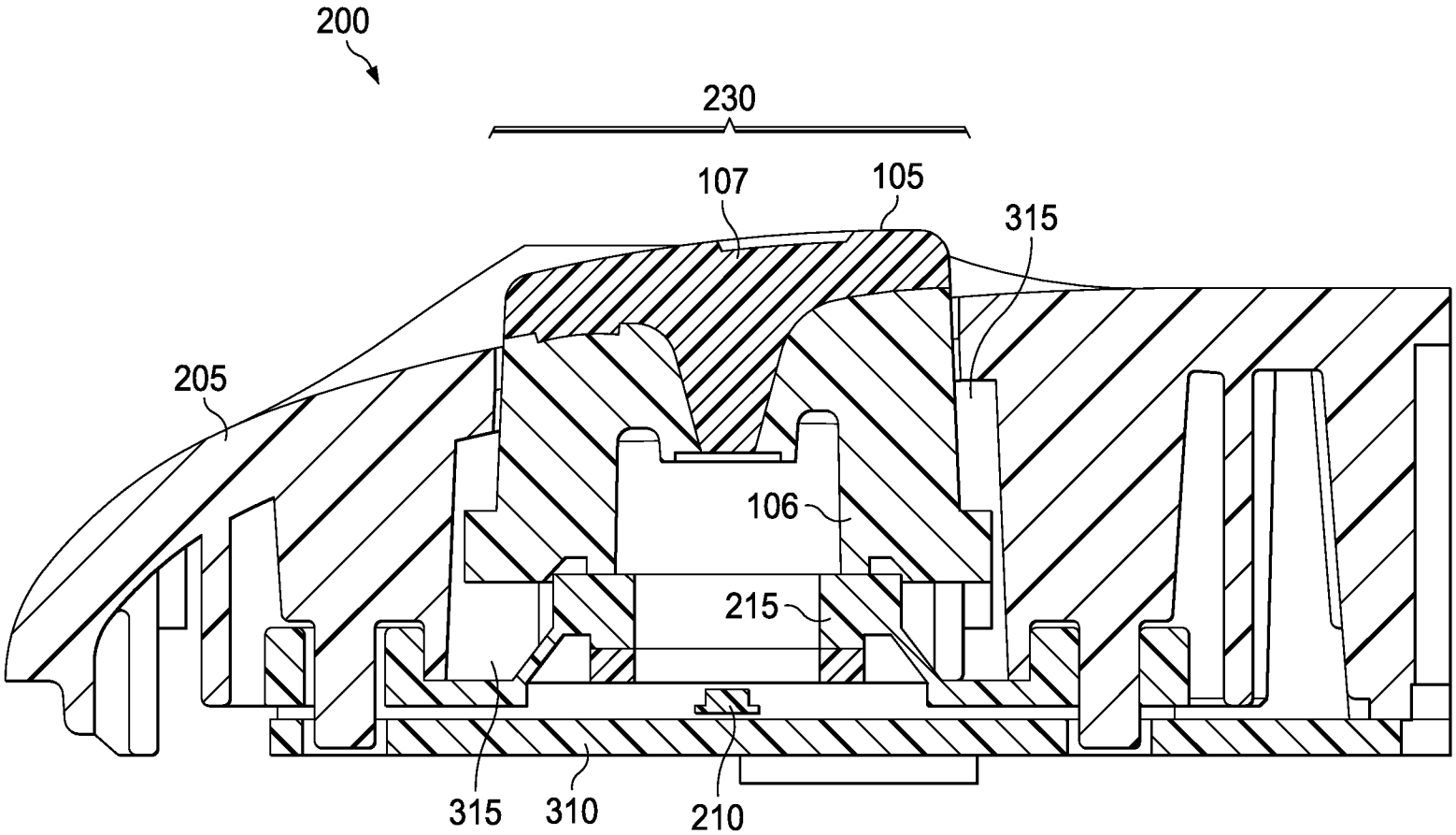
FIG. 3A shows an example cross-section of a hardware product according to an embodiment of the disclosed subject matter.

FIG. 3A illustrates an example cross-sectional view of hardware product 200. As in FIG. 2, button 105 may be located within the opening 230 of the housing 205. An internal cavity 315 may exist within hardware product 200 where the PCB 310 and the single light-emitting component 210 may be located. A resilient silicone web 215 may also be located within the internal cavity 315 to provide a spring-like resisting force to return the button 105 to its original position after being depressed axially by a user. Light-emitting component 210 may be a single LED, single incandescent bulb, or multiple LEDs operating together and confined within a space having a diameter less than or equal to 75-85%, more preferably about 80% of the diameter of a circle bounding the exterior surfaces of button 105. For example, for a button 105 that is about 10 mm in diameter or that otherwise may be bounded by a 10 mm diameter circle, one or more LEDs may be contained within a space of not more than about 8 mm in diameter, or about 50 $mm^2$ in area and disposed entirely under the button. In some cases, the light-emitting component 210 may be disposed within a smaller region, such as a region entirely under the button and having a diameter of 75%, 70%, 60%, 50%, or smaller relative to the diameter of the button. Light-emitting component 210 may be located underneath button 105 approximately along the center-line axis of button 105 and project light approximately along the center-line axis of button 105 in the direction of opening 230. The center-line axis of button 105 may be approximately parallel to the direction in which the button 105 may be depressed axially and approximately perpendicular to its exterior-facing surface.

Button 105 may be manufactured using a multiple-shot injection molding process. A first shot of material 106 may be composed from a light diffusion material that exhibits appropriate amount of light diffusion and transmissivity for the light projected axially from light-emitting component 210. For example, the first shot of material 106 may be a light diffusion grade polycarbonate or similar. A second shot of material 107 may provide a cosmetic surface for the button 105, which is generally viewable to a user and acted upon using a finger or thumb to depress button 105 axially. Second shot of material 107 may include, for example, an embossed icon, as shown in FIG. 1 and FIG. 2, that represents the function activated by depressing button 105. It should be appreciated that the terms "first shot of material" and "second shot of material" do not imply any particular ordering in terms of how button 105 may be molded. For example, the first shot of material 106 may be the second material injected, while the second shot of material 107 may be the first shot injected. Generally, the materials used in the multiple-shot injection molding process may be injected in order from the material having the highest melting point to the material having the lowest melting point. Second shot of material 107 may be optically opaque and moldable with the first shot of material 106, such as acrylonitrile butadiene styrene (ABS) plastic, a combination of polycarbonate and ABS plastic, or similar. Additionally, colorant may be added to the second shot of material 107 to increase its opacity. In this way, light from light-emitting component 210 may be projected only from the perimeter of button 105 to create the desired uniform ring effect. Alternatively, the second shot of material 107 may be composed of the same light-diffusing material as the first shot of material 106 where illuminating the cosmetic surface of button 105 is desired.

Figure 4A:
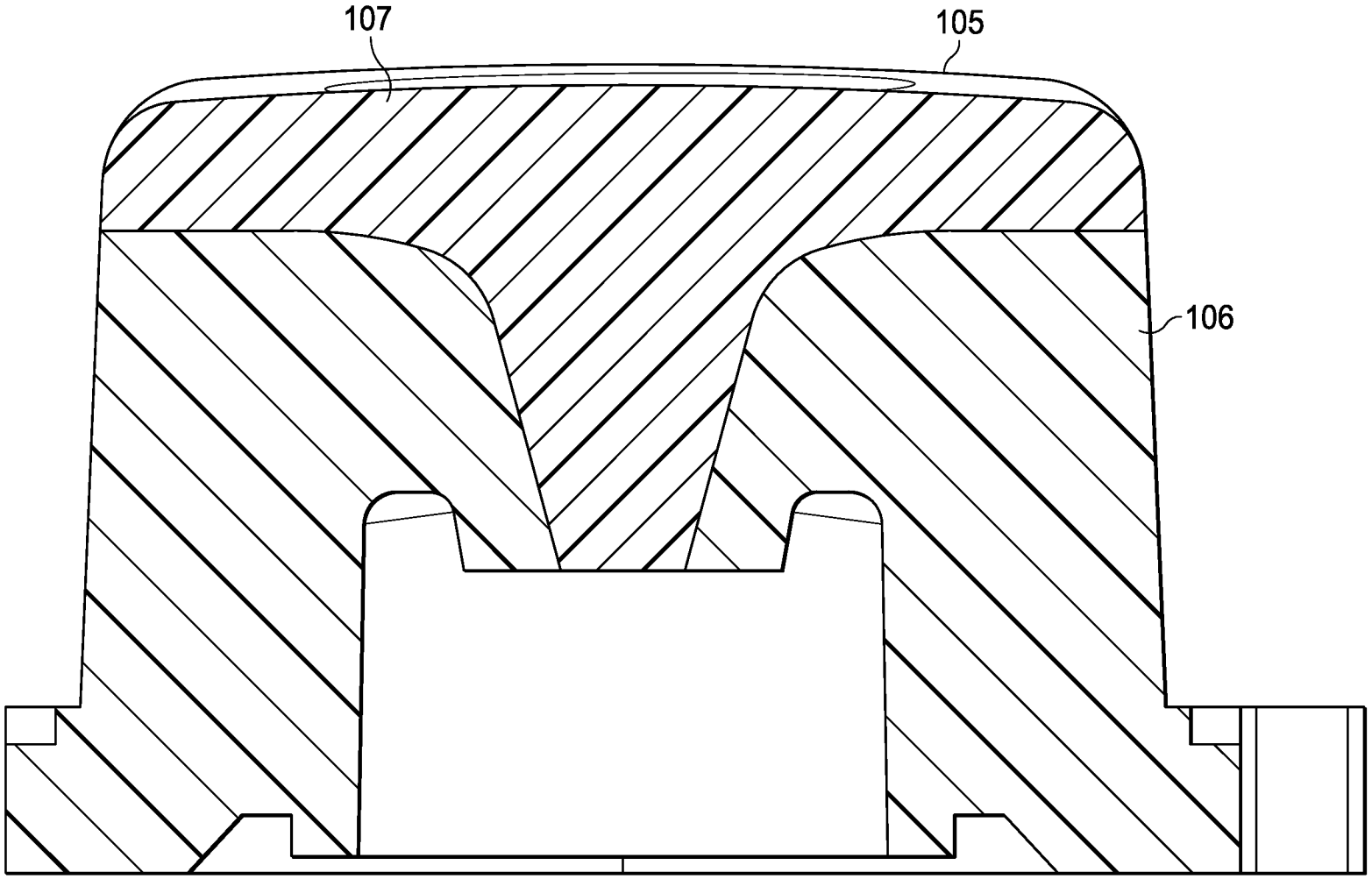
FIG. 4A shows an example cross-section of a multiple-shot component according to an embodiment of the disclosed subject matter.
Figure 4B:
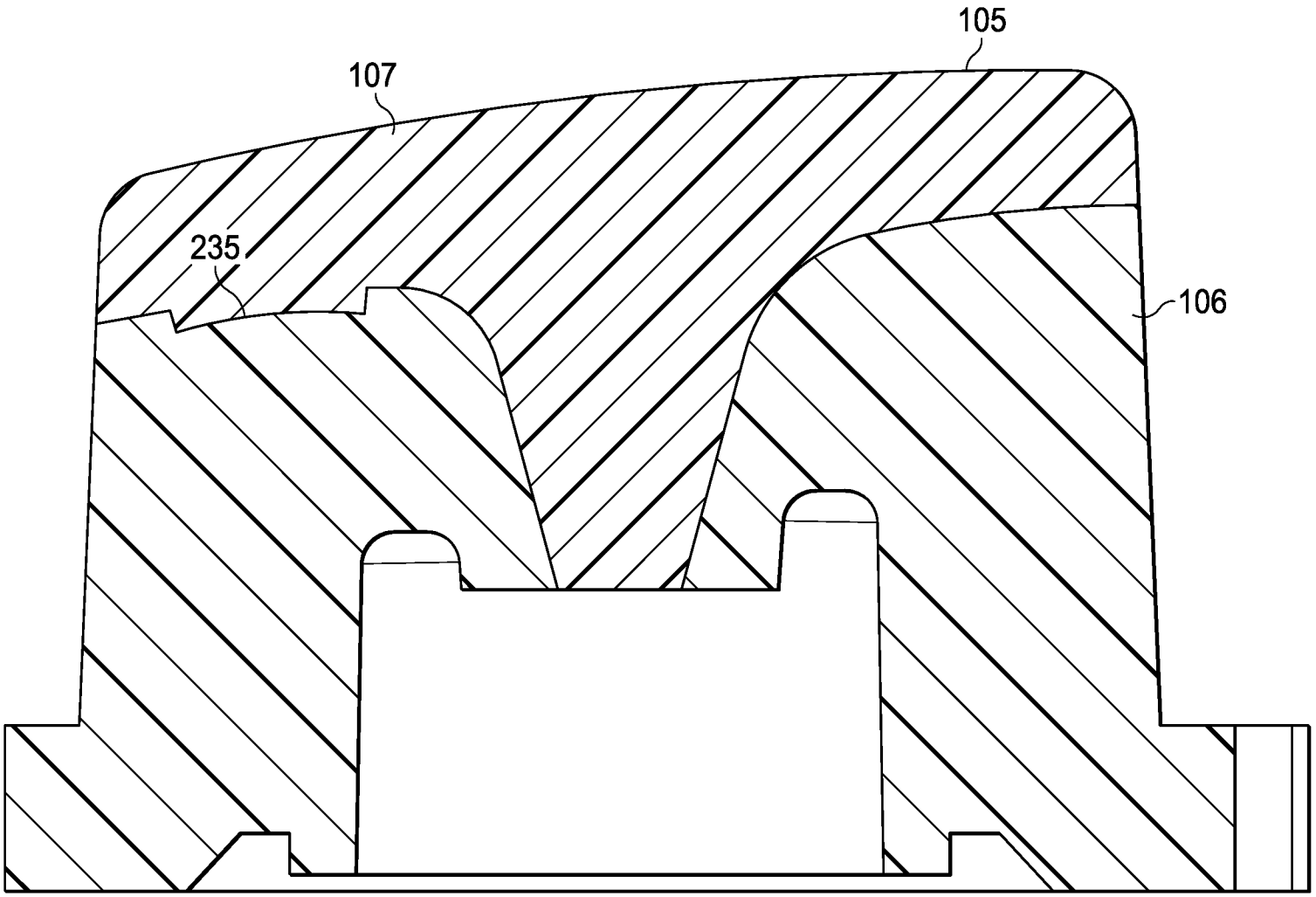
FIG. 4B shows an example cross-section of a multiple-shot component according to an embodiment of the disclosed subject matter.
Figure 5A:
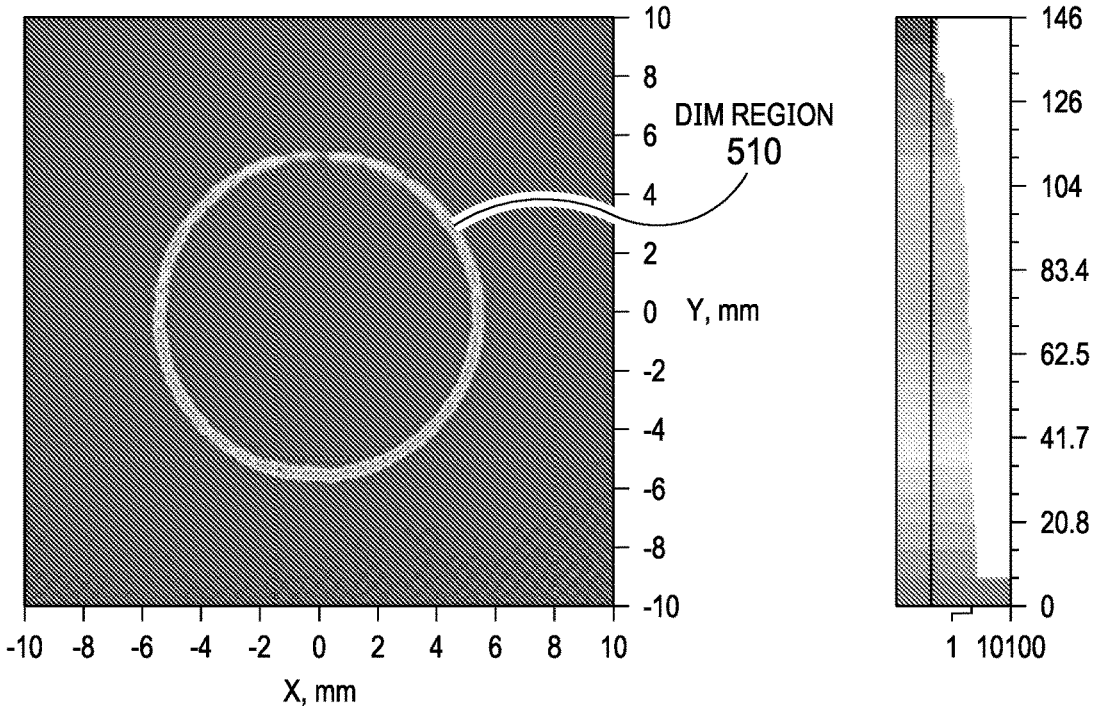
FIG. 5A shows an example illumination image of a non-uniform light ring effect.
Figure 5B:
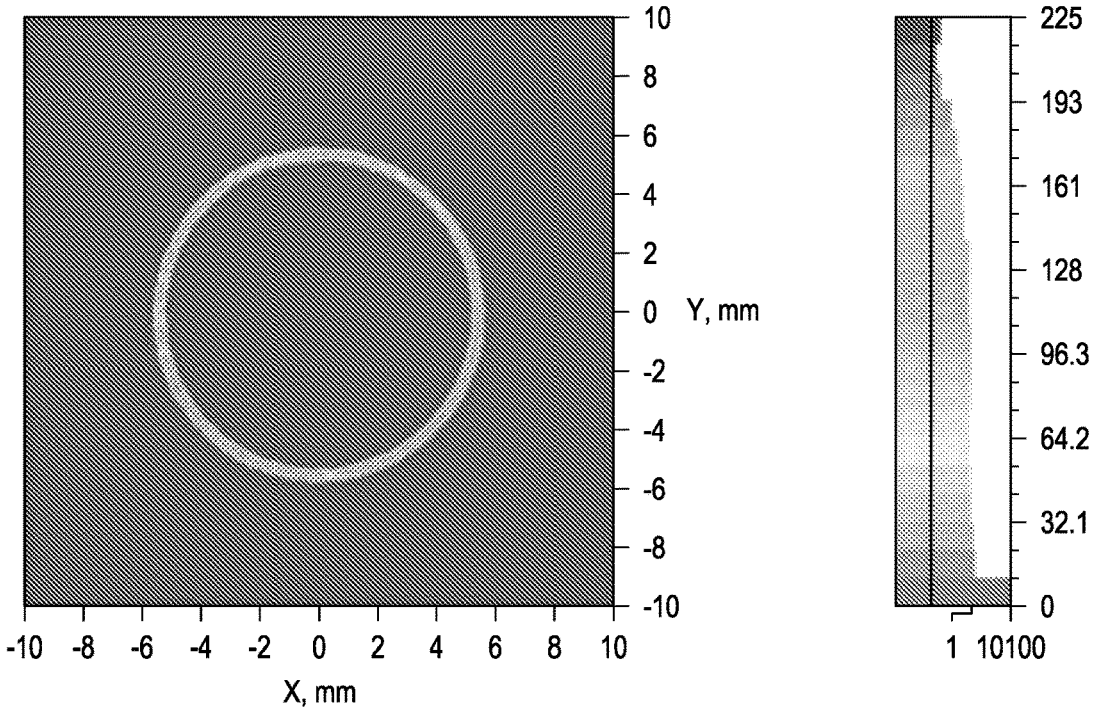
FIG. 5B shows an example illumination image of a uniform light ring effect according to an embodiment of the disclosed subject matter.

FIGS. 4A and 4B illustrate respective front and side cross-sectional views of button 105. As shown in FIGS. 4A and 4B, the molding gating of the button 105 may be preferably radially symmetric to create a uniform light ring effect and to prevent overflow between the first 106 and second 107 shots. Light-diffusing components that are non-radially symmetric are associated with producing non-uniform light ring effects. For example, where a two-shot light-diffusing button design has been manufactured using a non-radially symmetric tunnel-slide gate positioned on the side of the button, it has been shown that the resulting light ring exhibits a measurably dim region corresponding to the location of the gate. FIG. 5A illustrates a luminance image 500 of a non-uniform light ring effect where a region 510 is dim when compared to the remainder of the light ring. The light ring effect shown in FIG. 5A may be the result of using a non-radially symmetric molding gating. To overcome this issue, the second shot of material 107 may be injected through a molding gate centrally located on the underside of button 105, thereby preserving the radial symmetry of the molding gating. The first shot of material 106 may be injected through molding gate 235, which may be located underneath and completely obscured by second shot of material 107. In this way, neither molding gate may adversely affect the uniformity of the light ring produced when the light-emitting component 210 is powered and emitting light. Additionally, neither molding gate 235 used for the first shot of material 106 or the molding gate used for the second shot of material 107 may be visible from the exterior of product 200. FIG. 5B illustrates a luminance image 520 of a uniform light ring effect according to an embodiment of the disclosed subject matter. Notably, the light ring effect shown in FIG. 5B appears uniform without any visible gaps or dim regions.

The function of the button 105 may be provided by a resilient silicone web 215 having a conductive carbon pill, or the like, to cause the closure of a circuit upon depressing button 105 axially toward PCB 310. The circuit to be closed may be a momentary-type switch located on PCB 310. The silicone web 215 may be located between the first shot of material 106 of the button 105 and the light-emitting component 210. The silicone web 215 may constructed from an optically opaque material and include an opening directly above the light-emitting component 210 to allow light to pass into the first shot of material 106 of the button 105. Silicone web 215 may be constructed in a variety of ways to configure the tactile response of the button 105 when depressed. For example, by varying the density of the web structure, the resistance of the button may be adjusted. Similarly, the design of the silicone web 215 may affect whether the button 105 depression occurs smooth and gradually or sharp and rapidly.

Figure 3B:
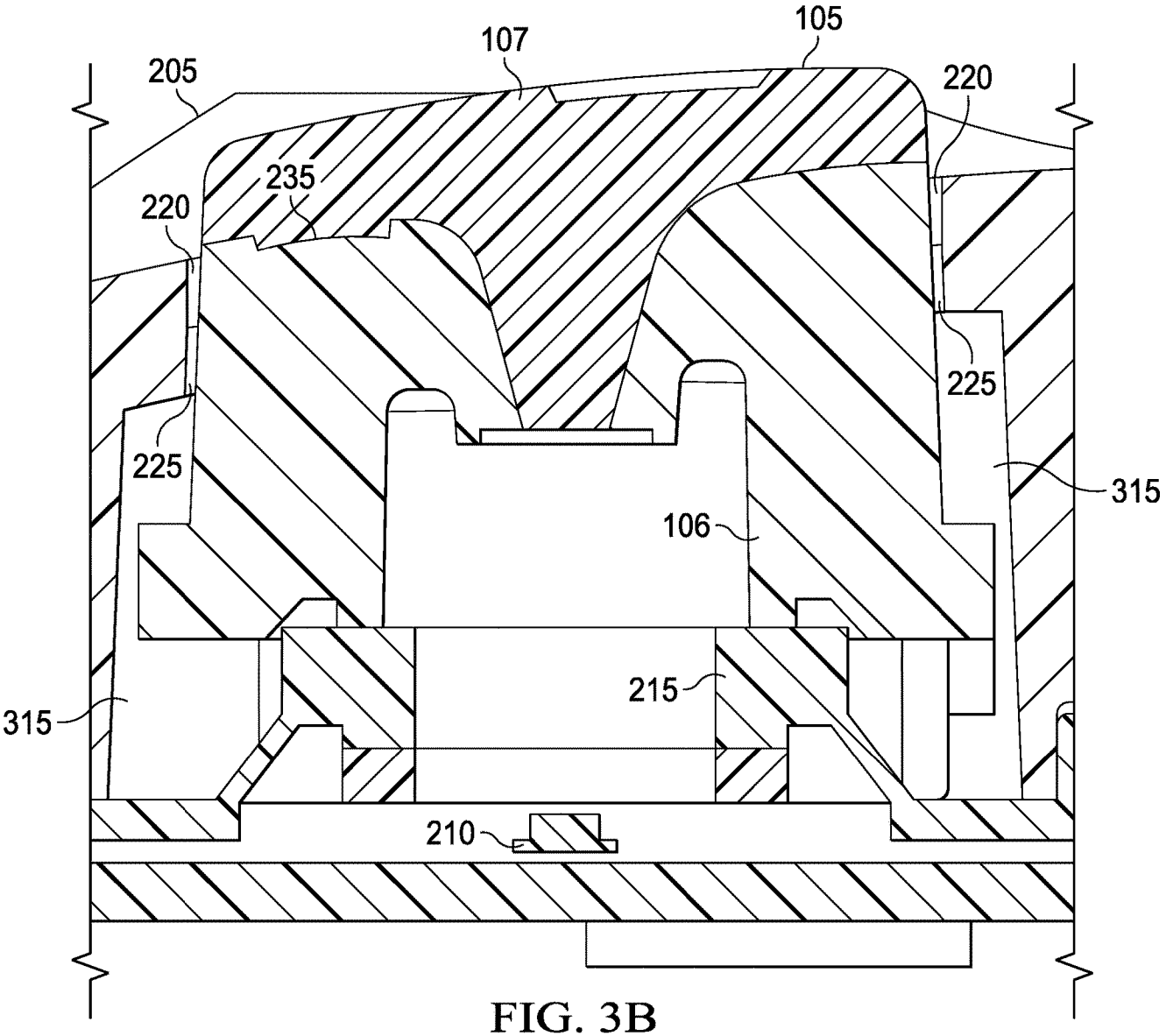
FIG. 3B shows an example cross-section of a hardware product according to an embodiment of the disclosed subject matter.

With reference to FIG. 3B, as previously discussed, the light-emitting component 210 may project light through the opening in silicone web 215 into the light-diffusing first shot of material 106. To provide adequate exposure to the exterior of product 200 and to ensure that the light ring may be seen from a variety of angles, first shot of material 106 may be preferably sized or positioned such that it protrudes from the exterior surface of housing 205. Alternatively, or in addition, the draft angles of housing 205 and first shot of material 106 may be adjusted to allow the desired amount of light to reach the exterior of product 200. In an example, the draft angles may range from 0 to 20 degrees and may be configured based on the position of a parting line located within the annular gap 220 and further described in the subsequent discussion. As the second shot of material 107 may be made from an optically opaque material, little or no light may be transmitted through it. Therefore, the light may be visible to a user via an annular gap 220 that surrounds the button 105. Annular gap 220 may be referred to as the "cosmetic gap," since its width affects the cosmetic appearance of the light ring effect. It should be appreciated that where the component with which the ring effect to be achieved is not annular, the surrounding opening may not be annular, but may approximately follow the footprint or perimeter shape of the button, joystick, trackball, or other component.

Light leakage throughout the interior of product 200 may be controlled to avoid illuminating undesirable portions of product 200 assembly, such as housing seams, fastener holes, and where other moving components emerge. This may be accomplished by including an optically opaque shroud 305 that may surround button 105 internally, by using optically opaque materials, and by sizing the thickness of the surrounding components so that light cannot pass. For example, the depth of cosmetic gap 220, or stated another way, the thickness of housing 205 in the area surrounding button 105, may be sized such that light passing through first shot of material 106 cannot leak through housing 205. Light leakage through housing 205 and/or second shot of material 107 may reduce the contrast of and thereby diminish the light ring effect. Housing 205 may be constructed from optically opaque materials to reduce the possibility of light leakage.

The button 105 may be centered within opening 230 and specifically within cosmetic gap 220 to achieve a uniform light ring effect. Where the button 105 is not centered, the distance between button 105 and housing 205 may be uneven, reducing the thickness of the light ring where cosmetic gap 220 is smaller and increasing the thickness of the light ring where cosmetic gap 220 is larger.

In an embodiment where the component to be illuminated is a moving component, such as the button 105, a "functional gap" 225 may be implemented in addition to the cosmetic gap 220. The functional gap 225 may not be included where the component to be illuminated is stationary. Functional gap 225 may be located directly adjacent to and in between cosmetic gap 220 and interior cavity 315. Functional gap 225 may allow for constrained movement between button 105 and housing 205. It should be appreciated that the size of functional gap 225 may affect the degree to which button 105 may be shifted laterally by the user. In an extreme case, a user may shift button 105 so that the functional gap 225 is reduced to zero on one side of the button 105 and the functional gap 225 is doubled on the opposite side of the button 105. Because shifting button 105 laterally may otherwise diminish the uniformity of the light ring effect, the cosmetic gap 220 is preferably larger at the surface of housing 205 than where the functional gap 225 meets the cosmetic gap 220. In this way, even if a user shifts button 105 laterally to eliminate the functional gap 225, the cosmetic gap 220 may remain, thereby allowing light projected from light-emitting component 210 to reach housing 205 and to maintain the light ring effect.

As shown in FIG. 3B, the cosmetic gap 200 may be of a larger dimension at the exterior surface of housing 205 and taper to its minimum dimension where it meets functional gap 225. Similarly, functional gap 225 may be of a larger dimension where it meets interior cavity 315 and taper to its minimum dimension where it meets cosmetic gap 200 above. Both the cosmetic gap 220 and the functional gap 225 may each exhibit their respective minimum dimensions where they meet, forming a parting line and creating a substantially hourglass-shaped gap when viewed together as a whole. The maximum dimension of functional gap 225 may be less than the maximum dimension of cosmetic gap 220. The cosmetic gap 220 may be between 0.10 and 0.20 millimeters, while functional gap 225 may be in the range of 0.10-0.30 mm, more preferably 0.15-0.25 mm, or more preferably between 0.17 and 0.27 millimeters. In an example, the functional gap may be approximately 0.15 millimeters, and the cosmetic gap may be approximately 0.22 millimeters. By designing the cosmetic gap 220 and functional gap 225 in this manner, any friction resulting from laterally shifting button 105 toward housing 205 during depression may be reduced since the point of contact between button 105 and the housing 205 may be minimal.

The embodiments disclosed herein may reduce the number of components and associated costs of producing a light ring effect with a dead front effect than conventional light ring designs. The embodiments disclosed herein may be applicable to non-moving, moveable, and moving components of any shape, such as buttons, directional pads, joysticks, trackballs, wheels, switches, sliders, labels, panels, trackpads, and embossments, for example. Embodiments disclosed herein may be useful in the context of product safety and reliability since there are no paints or coatings that may fail or degrade over time. The disclosed subject matter may be scalable in size, space efficient, and may be used in a greater variety of types of products to produce a light ring effect with a dead front than previously possible.

Although examples and descriptions provided herein use terminology that may be associated with specific fabrication techniques, such as a "shot" of material, it will be understood that a variety of manufacturing techniques may be used to fabricate devices disclosed herein without departing from the scope or content of the disclosed subject matter. For example, devices disclosed herein may be fabricated using techniques such as single injection-shot molding, multi-shot injection molding, gas-assist molding, coinjection techniques, reaction-injected molding, rotational molding, thermoforming, compression molding, or any other suitable technique that is capable of achieving the physical components disclosed herein.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A hardware product comprising:

a housing having an opening;

a light-emitting component; and a button disposed in the opening and having a first shot of material configured to disperse light and a second shot of optically opaque material overlying the first shot of material such that when the light-emitting component is activated the button is configured to project light only from a perimeter of the button and the button and housing together present a ring of light effect in a gap between the button and the housing and when the light-emitting component is deactivated the button and housing together present a dead front effect.

2. The hardware product of claim 1, further comprising:

a silicone web configured to cause closure of a circuit upon depression of the button and to return the button to its original position after being depressed, the silicone web having an opening centrally aligned with the light-emitting component and configured to allow light from the light-emitting component to pass to the first shot of material.

3. The hardware product of claim 2, wherein the silicone web comprises an optically opaque material.

4. The hardware product of claim 1, wherein the first shot of material is positioned or sized such that the first shot of material protrudes outward from the housing.

5. The hardware product of claim 1, wherein at least a portion of the housing disposed near the opening has a thickness such that light passing through the first shot of material cannot leak through the at least a portion of the housing disposed near the opening.

6. The hardware product of claim 1, wherein the opening includes an annular gap surrounding the button.

7. The hardware product of claim 6, wherein a thickness of the ring of light effect is based on a size of the annular gap.

8. The hardware product of claim 6, wherein the housing comprises a functional gap disposed under the annular gap.

9. The hardware product of claim 8, wherein the annular gap includes a larger dimension at an exterior surface of the housing and tapers to a minimum dimension where it meets the functional gap.

10. The hardware product of claim 8, wherein a maximum dimension of the functional gap is less than a maximum dimension of the annular gap.

11. The hardware product of claim 8, wherein the functional gap is disposed adjacent to the annular gap in parallel with a depression axis of the button.

12. The hardware product of claim 1, wherein the button is substantially centered in the opening so as to produce a substantially uniform ring of light effect.

13. The hardware product of claim 1, wherein the light-emitting component comprises a single light-emitting component.

14. The hardware product of claim 1, wherein the light-emitting component comprises multiple light-emitting components position within a diameter of a circle.

15. The hardware product of claim 14, wherein the diameter of the circle is less than or equal to 80% of a diameter of an exterior-facing surface of the button.

16. The hardware product of claim 1, wherein the first shot of material comprises a light diffusion grade polycarbonate.

17. The hardware product of claim 1, wherein the second shot of optically opaque material comprises at least one of polycarbonate or acrylonitrile butadiene styrene.

18. An electronic device comprising the hardware product of claim 1.

19. The electronic device of claim 18, wherein the electronic device comprises at least one of a game controller, a game console, a remote control, a set-top box, a thermostat control panel, a security system control panel, a dimmer/switch, or an audio system control panel.

* * * * *